US006244593B1

(12) United States Patent
Schaefer et al.

(10) Patent No.: US 6,244,593 B1
(45) Date of Patent: Jun. 12, 2001

(54) SHEET DIVERTER WITH NON-UNIFORM DRIVE FOR SIGNATURE COLLATION AND METHOD THEREOF

(75) Inventors: Karl P. Schaefer, Brookfield; Ingermar S. d'Agrella, Sussex, both of WI (US)

(73) Assignee: Quad/Tech, Inc., Sussex, WI (US)

( * ) Notice: Subject to any disclaimer, the term of this patent is extended or adjusted under 35 U.S.C. 154(b) by 0 days.

(21) Appl. No.: 09/372,328

(22) Filed: Aug. 11, 1999

(51) Int. Cl.[7] ..... B65H 5/34
(52) U.S. Cl. ..... 271/270; 271/272; 271/302
(58) Field of Search ..... 271/270, 272, 271/302, 303

(56) References Cited

U.S. PATENT DOCUMENTS

| | | | | |
|---|---|---|---|---|
| 399,987 | | 3/1889 | Goss . | |
| 2,287,800 | * | 6/1942 | Hawkes | 271/270 |
| 3,100,113 | | 8/1963 | Bennett et al. | 271/71 |
| 3,820,775 | | 6/1974 | Miller | 271/64 |
| 3,858,870 | * | 1/1975 | Yabe et al. | 271/272 |
| 3,904,019 | | 9/1975 | Carlen et al. | 198/31 |
| 3,960,079 | * | 6/1976 | Capetti | 271/270 |
| 4,008,891 | | 2/1977 | Buys | 271/263 |
| 4,195,831 | | 4/1980 | Sutera | 271/302 |
| 4,373,713 | | 2/1983 | Loebach | 271/303 |
| 4,538,800 | | 9/1985 | Richter | 271/120 |
| 4,729,282 | | 3/1988 | Kasdorf | 83/26 |
| 4,732,377 | | 3/1988 | Fenske et al. | 271/303 |
| 4,890,826 | | 1/1990 | Rutishauser | 271/296 |
| 4,948,112 | | 8/1990 | Sato et al. | 270/60 |
| 5,018,718 | * | 5/1991 | Matsuno et al. | 271/270 |
| 5,043,771 | * | 8/1991 | Shibata et al. | 271/270 |
| 5,150,894 | | 9/1992 | Ricciardi | 271/302 |
| 5,472,185 | | 12/1995 | Kollann et al. | 271/303 |
| 5,607,146 | | 3/1997 | Novick et al. | 270/42 |
| 5,615,878 | | 4/1997 | Belanger et al. | 271/302 |
| 5,702,100 | * | 12/1997 | Novick et al. | 271/302 |

FOREIGN PATENT DOCUMENTS

| | | | | |
|---|---|---|---|---|
| 2607 503 | * | 9/1976 | (DE) | 271/270 |
| 404 140 0261 | * | 5/1992 | (JP) | 271/270 |

* cited by examiner

*Primary Examiner*—H. Grant Skaggs
(74) *Attorney, Agent, or Firm*—Michael Best & Friedrich LLP

(57) ABSTRACT

Provided is a sheet diverter for directing signatures moving in serial fashion along a path to one of a plurality of collation paths. The sheet diverter includes a non-uniform angular velocity drive mechanism, the function of which is to improve the collation process such that the quality of signatures is improved as the signatures move along one of the plurality of collation paths and to increase the speed of the folder.

21 Claims, 6 Drawing Sheets

SHEET DIVERTER WITH NON-UNIFORM DRIVE FOR SIGNATURE COLLATION AND METHOD THEREOF

FIELD OF THE INVENTION

The present invention relates, generally, to sheet diverters for directing sheets moving in serial fashion along a path to one of a plurality of collation paths and, more particularly, to a high speed sheet diverter of the foregoing kind for collation of printed signatures to be used in the binding of a publication such as a magazine or a newspaper. The present invention further relates to methods for collating sheets, such as signatures, from a high speed printing press. Specifically, the present invention provides a sheet diverter with a non-uniform drive mechanism, the function of which is to improve the collation process such that the quality of signatures is improved as the signatures move along one of a plurality of collation paths and to allow a faster machine speed.

BACKGROUND OF THE INVENTION

Sheet diverters may range from the collating apparatus associated with an office copier, to sheet or web handling devices employed in the manufacture of paperboard articles, to sheet diverters specifically adapted to collate signatures to be used in binding or otherwise assembling books, magazines or newspapers. Each of these environments presents a somewhat different challenge in designing an efficient diverter or collator, but the same objective tends to dominate the entire class of apparatus, namely, accurately routing selected flexible webs or ribbon sections along a desired collating path to achieve a desired order.

In the printing industry, a desired image is repeatedly printed on a continuous web or substrate such as paper. The ink is dried by running the web through curing ovens. In a typical printing process, the web is subsequently slit (in the longitudinal direction which is the direction of web movement) to produce a plurality of continuous ribbons. The ribbons are aligned one on top of the other, folded longitudinally, and then cut laterally to produce a plurality of multi-paged, approximately page-length web segments, termed signatures. A signature can also be one printed sheet of paper that has or has not been folded. It is often desirable to transport successive signatures in different directions. In general, a sheet diverter operates to route a signature along a desired one of a plurality of paths.

A sheet diverter in a folder at the end of a printing press line must be operable at the high speeds of the press line, typically in excess of 2,000–2,500 feet per minute (fpm). It is desirable to run both the press and folder at the highest speed possible in order to produce as many printed products as possible in a given amount of time. However, the physical qualities of paper or similar flexible substrates moving at a too high rate of speed often results in whipping, dogearring, tearing, or bunching of the substrate. For example, the sudden impact force between the leading edge of a signature and a diverter wedge may result in the leading edge of the signature being damaged. Similarly, the trailing edge of a signature may slap against the top vertex edge of a diverter wedge, resulting in damage to the trailing edge. The trailing edge of the signature may tear, or be unintentionally folded on the corners. Damaged signatures may be of unacceptable quality and may also lead to jams in the folder, resulting in downtime and repair expense.

Many of the foregoing defects become more prevalent above certain speeds of the printing press and folder. For example, such defects may occur when the press is run at a high rate of speed, say greater than 2,500 fpm, but may not occur when the press is run at a slower speed, for example, 2,200 fpm. As machine speeds increase, it becomes increasingly more and more important to provide a system which allows for individual signatures to be directed down any one of a plurality of selected collation paths without damaging the leading or trailing edge of each signature.

A sheet diverter for signature collation and a method thereof is described in U.S. Pat. No. 4,729,282, which is hereby incorporated by reference. U.S. Pat. No. 4,729,282 discloses a sheet diverter including an oscillating diverter guide member that directs successive signatures to opposite sides of a diverter wedge.

At excessively high speeds, the tail end of a signature may be damaged due to whipping of its tail end at the apex of a diverter wedge. At excessive speeds, the diverter may direct the tail end part of a signature to the wrong side of a diverter wedge before the trailing edge of the signature has passed the apex of the diverter wedge. As the trailing edge of the signature reaches the apex, the end of the signature will be "whipped," i.e., tailwhipped, back to the correct side of the diverter wedge to which the preceding portion of the signature traveled along, thereby possibly damaging the tail end of the signature.

Thus, there is a need for a sheet diverter that is capable of operating at high speeds and yet being capable of providing a signature that is acceptable in quality. What is further needed is a sheet diverter for use in the printing industry such that the sheet diverter improves the collation process of printed signatures to prevent or minimize damage to the signatures as the signatures move along one of a plurality of collation paths. Particularly, what is also needed is a sheet diverter that prevents or reduces tailwhip of the end of a signature as the signature travels past the apex of a diverter wedge thereby allowing for greater operational speeds and increasing the quality of each signature.

SUMMARY OF THE INVENTION

The present invention provides a sheet diverter that prevents or minimizes the potential for damage to the trailing ends of sheets such as signatures. According to one aspect of the present invention, the invention utilizes a new non-uniform drive for a sheet diverter.

In one embodiment of the present invention, elliptical gears are employed. In accordance with the present invention, a first shaft and a second shaft are synchronized at 0 degrees and 180 degrees of rotation. However, as the shafts rotate, at times, the second shaft lags behind the first shaft by virtue of the manner in which elliptical gears operate. The retardation of the second shaft delays the translation of a diverter nip or gap, defined as being between diverter rolls and through which a signature travels, to the opposite side of a diverter wedge so that the diverter rolls are in a more favorable position to prevent whipping of the trailing end of a signature in a collation process as the signature travels past the apex of a diverter wedge.

After the trailing edge of a signature has advanced past the apex of a diverter wedge, the diverter rolls translate the diverter nip to the other side of the diverter wedge in order to feed the next signature. The diverter nip moves from one side of the apex of the diverter wedge to the other side as the first and second shafts rotate and the second shaft advances and "catches-up" with the first shaft so that the first and second shafts are again synchronized at 0 degrees and 180 degrees respectively. The speed of the second shaft is optimized for the high speed movement of signatures. The phase adjustment of the second shaft may be set during machine assembly through an adjustable bushing or bushings or may be adjustable during machine operation by using a motorized phase adjuster differential.

In a second embodiment of the present invention, a conjugate cam system is employed. A conjugate cam assembly converts the constant angular velocity of a first shaft into a non-constant angular velocity of a second shaft. In this way, the translation of the diverter rolls and diverter nip is controlled in a similar manner as that described with reference to the elliptical gears.

It is a feature of the invention to provide an apparatus that minimizes the potential for damage to signatures as they travel down one of a plurality of collation paths.

Another feature of the invention is the prevention or minimization of damage to the trailing end of a signature diverted through a folder, while allowing a printing press and the folder to operate at higher rates of speeds.

Still, another feature of the invention is to provide a sheet diverter in a printing press operation that provides for improved collation of signatures therethrough while eliminating the need for expensive, complicated equipment as is currently used in the industry. Thus, a feature of the invention is to provide a simple, inexpensive device to improve the collation process in a sheet diverter of a printing press and folding operation.

Yet another feature of the invention is to provide a method whereby signatures travel down one of a plurality of collation paths in a folder such that the trailing ends of the signatures are not damaged as a result of cooperation with a diverter wedge of a sheet diverter of the folder.

A further feature of the invention is to provide various advance/retard mechanisms or non-uniform drive systems to time or manipulate the translation of a diverter nip or gap between diverter rolls of a sheet diverter such that the diverter nip does not move from one side of a diverter wedge to the other side of the diverter wedge until the trailing edge of a signature has proceeded past or substantially past the apex of the diverter wedge thereby preventing tailwhip of the trailing end and improving the overall quality of the signature.

Other features and advantages of the invention will become apparent to those skilled in the art upon review of the following detailed description, claims and drawings in which like numerals are used to designate like features.

Figure 1:
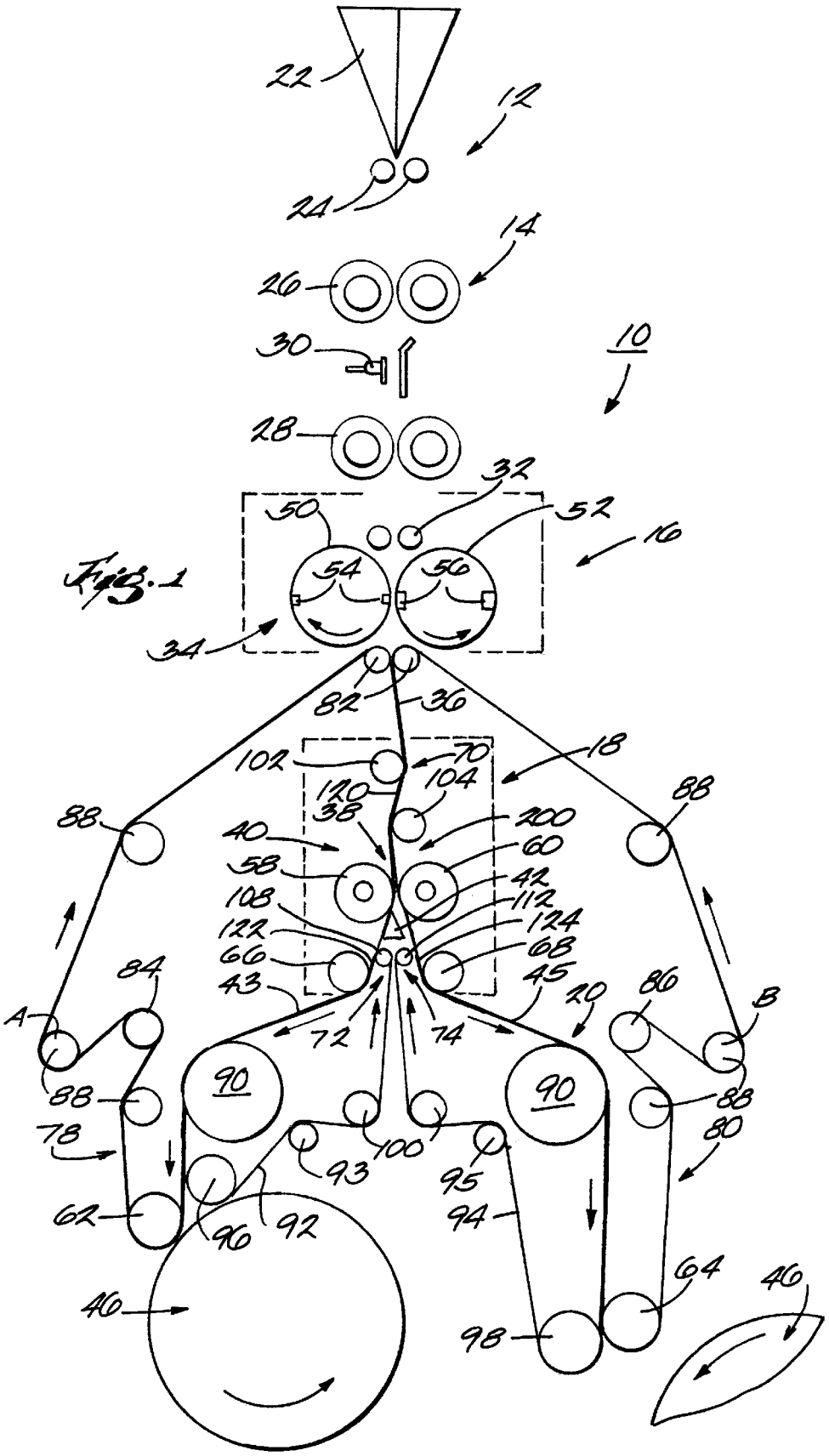
FIG. 1 is a schematic diagram of a pinless folder, a generally conventional forming board and associated drive and cutting sections, incorporating a sheet diverter in which the various embodiments of the present invention may be employed.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" and variations thereof herein is meant to encompass only the items listed thereafter and the equivalents thereof.

DETAILED DESCRIPTION OF THE PREFERRED EMBODIMENTS

Figure 4:
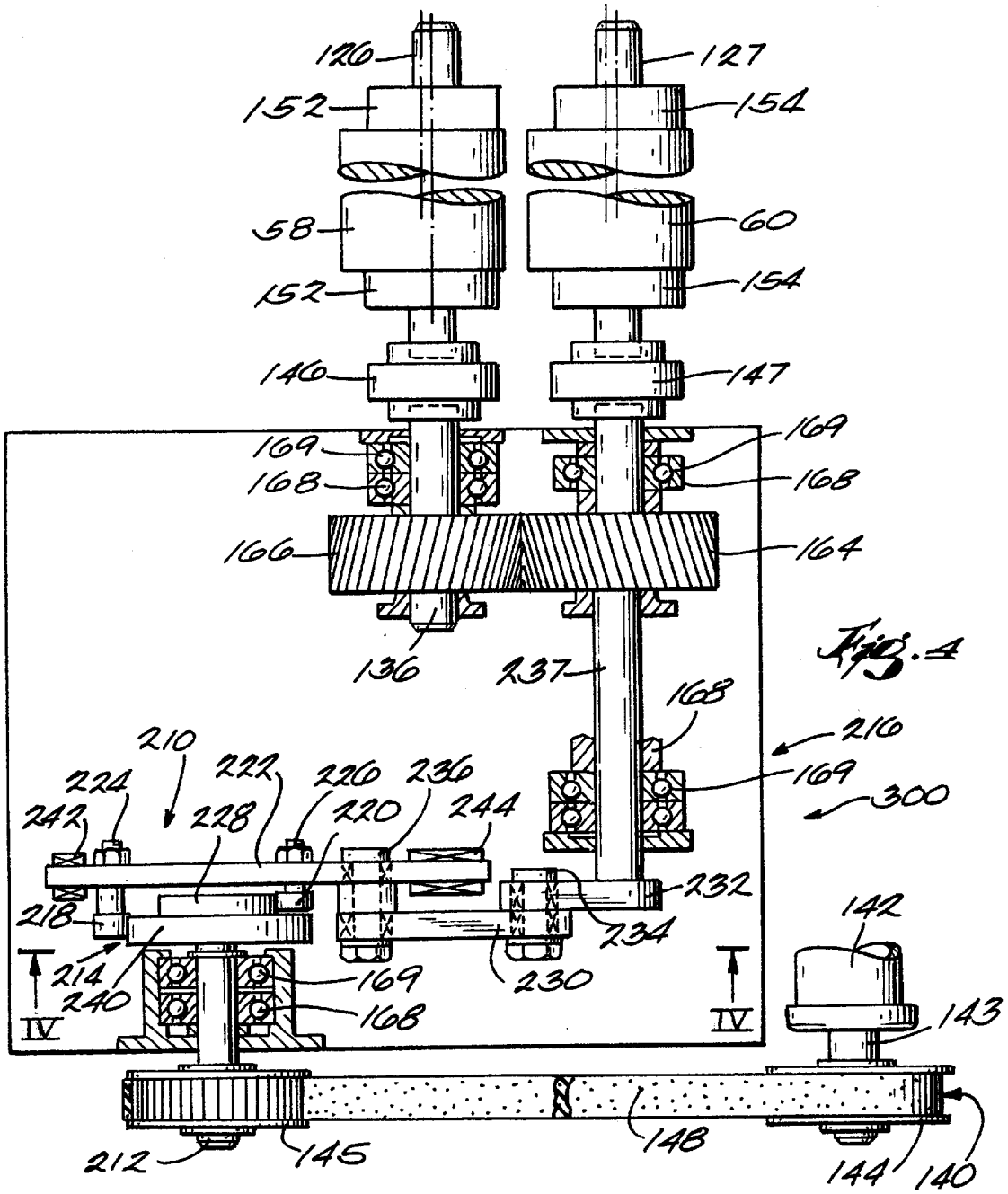
FIG. 4 is a top view of the diverter rolls of FIG. 2 showing another embodiment of an advance/retard mechanism according to the present invention.
Figure 4A:
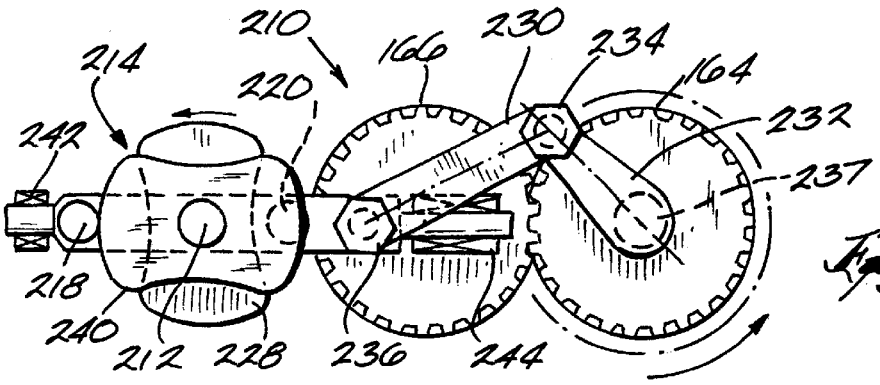
FIG. 4*a* is a side view taken along lines IV—IV of FIG. 4 showing a conjugate cam system according to the present invention.
Figure 5:
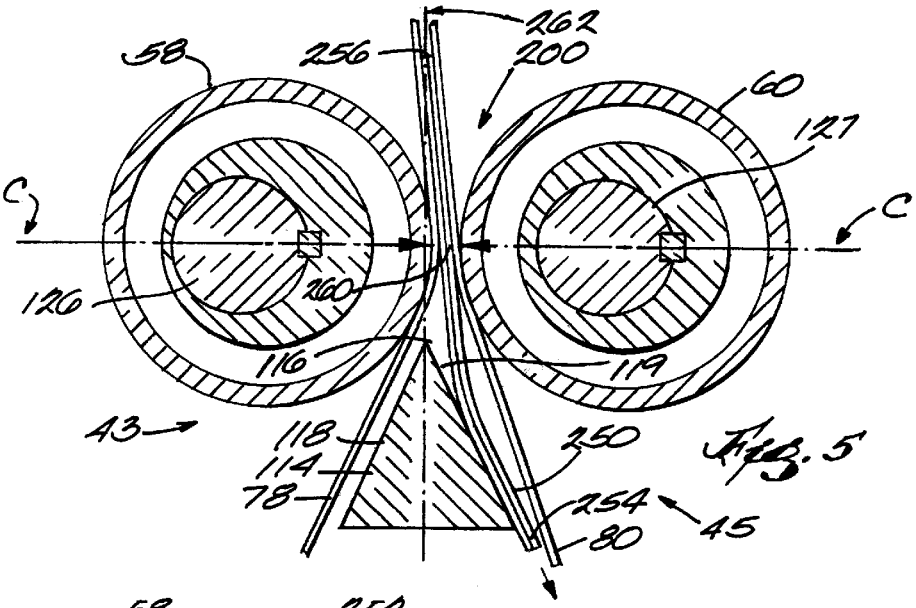
FIGS. 5–7 are cross section side views of the area enclosed by box II of FIG. 2 showing the advancement of a signature past a diverter wedge according to the present invention.
Figure 6:
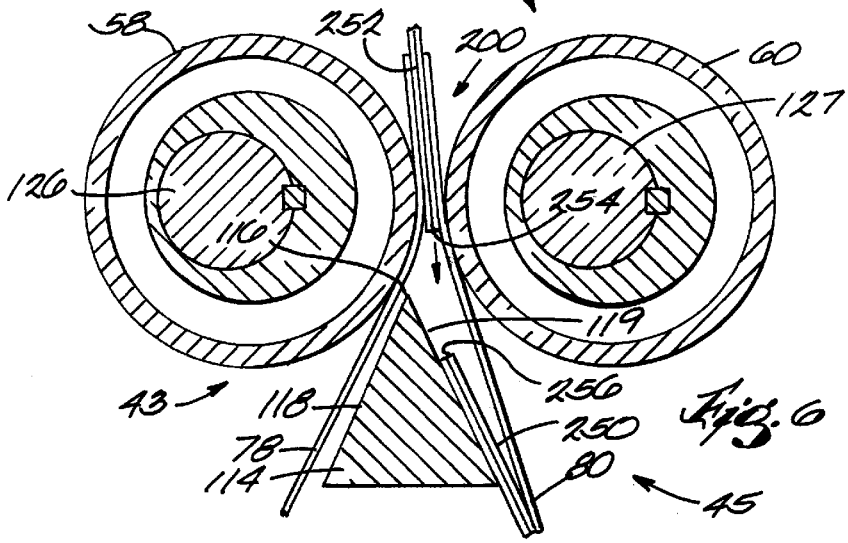
Figure 7:
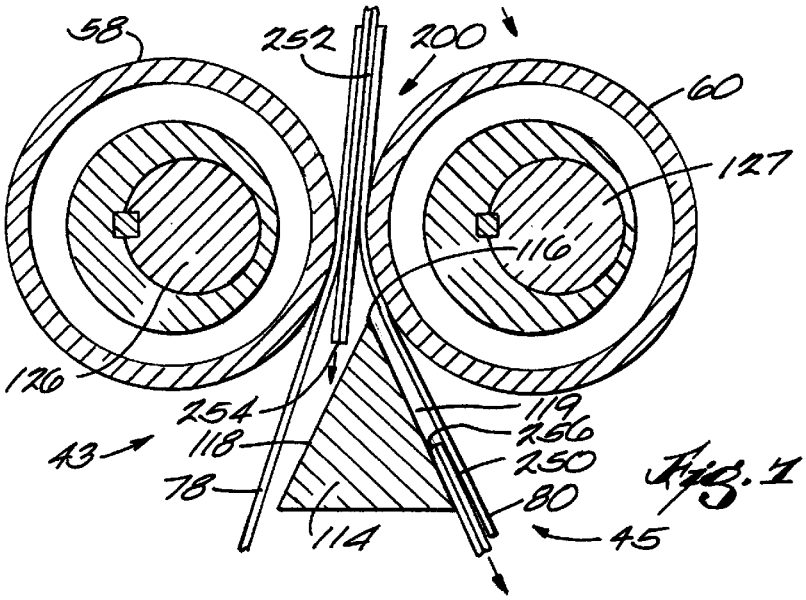

Illustrated in FIG. 1 of the drawings is a schematic of a folder 10 which is a portion of a high speed printing press (not shown). The folder 10 includes a forming section 12, a driving section 14, a cutting section 16, a diverting section 18 and a collating section 20. The invention described herein is primarily directed to the diverter section 18. Specifically, FIGS. 3 and 3*a*–3*f* show one embodiment of the present invention of an advance/retard mechanism for the translation of the diverter rolls of the diverter section. FIGS. 4 and 4*a* show another embodiment of the present invention of an advance/retard mechanism for the translation of the diverter rolls of the diverter section. FIGS. 5–7 exhibit how, according to the present invention associated with an advance/retard mechanism, a signature travels past the apex of a diverter wedge of a diverter section so that the trailing end of the signature is not significantly damaged during the collation process. Although certain components of folder 10 are set forth below, it should be noted that it is contemplated that the present invention is capable of use in any number of folder devices or applications according to the principles of the present invention.

The forming section 12 includes a generally triangularly shaped former board 22 which receives a web of material (or several longitudinally slit sections of the web termed "ribbons", wherein the ribbons are typically aligned one on top of the other) and folds the same. The fold is in a direction parallel to the direction of web travel. The folded web is then fed downwardly under the influence of a pair of squeeze rolls 24 by the drive section 14. The drive section 14 includes pairs of upper and lower drive rolls 26 and 28, respectively. These drive rolls transport the ribbon proximate a charging unit 30, if utilized, which applies a charge of static electricity to the traveling web to keep the paper leafs together. The web then encounters conditioning rolls 32 in the cutting section 16.

The web then passes into engagement with a cutting device 34. The web is segmented by the cutting device 34 into a plurality of individual signatures. Successive signatures enter the diverting section 18 along a diverter path 36. The signatures are led serially via opposed tapes to a sheet diverter 38, which includes an oscillating diverting guide mechanism 40 and a preferably stationary diverter wedge 42. The sheet diverter 38 deflects a signature to a selected one of a plurality of collation paths 43 or 45. The signature then enters the collating section 20 and is fed along one of the collation paths to a destination such as a fan delivery device 46 and subsequently to a conveyor (not shown), such as a shingling conveyor as is known in the art.

More specifically, the cutting device 34 includes a pair of counter-rotating cutting cylinders 50 and 52. One cylinder is fitted with a pair of cutting knives 54 and the other is formed with a pair of recesses 56. Since the cylinders include pairs of knives and opposed recesses, two cutting actions are achieved per single cylinder rotation. Suitable timing means, known to those of ordinary skill in the art, provide accurate registration of the image on the web with respect to the cutting device 34 to ensure proper cut dimensions for the web segments.

As mentioned, the sheet diverter 38 includes the oscillating diverting guide mechanism 40 and the diverter wedge 42. The mechanism 40 includes a pair of diverter idler rolls 58 and 60, eccentrically mounted on rotating shafts. The mechanism 40 operates to direct the lateral disposition of the leading edge of the signature relative to the wedge 42 which separates the two collation paths 43 and 45. The mechanism 40 reciprocates in a diverter plane which has a component generally perpendicular to the diverter path 36. One such diverter is described in U.S. Pat. No. 4,729,282, assigned to Quad/Tech of Pewaukee, Wis., which, as previously noted, is hereby incorporated by reference. Alternatively, diverting guide mechanisms such as those disclosed in, for example, U.S. Pat. Nos. 4,373,713, 4,948,112, 5,607,146 or 5,615,878, could be used in connection with the present invention, as could other known diverting guide mechanisms.

The signatures are routed through the diverter path 36 and to a selected one of the collation paths 43, 45 under the control of a signature controller means including a primary signature controller 70 and secondary signature controllers 72, 74. Preferably, the distance through the diverter between the primary signature controller 70 and respective secondary signature controllers 72, 74 is less than the length of the signature to be diverted. In this way, the selected secondary signature controller 72 or 74 assumes control of the leading edge of a signature before the primary signature controller 70 releases control of the trailing edge of the same signature. As used herein, the leading edge or end and trailing edge or end refer to the first or last inch or so of the signature.

The primary and secondary signature controllers 70, 72 and 74 preferably are comprised of opposed (face-to-face) belts or tapes disposed over rollers in an endless belt configuration. The primary signature controller 70 includes a first diverter belt 78 and a second diverter belt 80 which circulate in separate continuous loops in the directions shown by the arrows in FIG. 1, and are joined at a nip between a set of idler rollers 82 near the outfeed of the cutting section 16. Drive rollers 84 and 86 drive the diverter belts 78 and 80 respectively about idler rollers 82, a plurality of respective idler rollers 88, respective idler rollers 62, 64, and respective idler rollers 66, 68. Both diverter belts 78, 80 are driven by respective drive rollers 84, 86 at the same speed, which typically is from 8% to 15% faster than the speed of the printing press. The faster speed of the belts causes a gap to occur between successive signatures as the signatures flow serially down path 36 between the diverter belts 78, 80. The diverter belts 78, 80 are also driven around guide rollers 90. Guide rollers 90 have larger diameters than the other rollers so that when the direction of the signatures is changed, the signatures are bent as little as possible to avoid damage due to wrinkles at the backbone of the signature.

The primary signature controller 70 includes a soft nip 120 defined by an idler roller 102 and an abaxially disposed idler roller 104. The rollers 102 and 104 cause pressure between diverter belts 78 and 80 as these belts follow the diverter path 36 through the soft nip 120. The soft nip 120 compressively captures and positively drives a signature that passes therethrough.

The secondary signature controllers 72 and 74 include a first collator belt 92 and a second collator belt 94, respectively, which both circulate in separate continuous loops in the directions shown by the arrows in FIG. 1. The opposed collator belts 92, 94 share a common path with the diverter belts 78, 80 along the collation paths 43, 45, respectively, beginning downstream of the diverter wedge 42. In particular, collator belt 92 is transported around idler roller 90, roller 96, idler roller 100, and idler roller 108. Collator belt 94 is transported around idler roller 90, roller 98, idler roller 100, and idler roller 112. Belt take-up idler rollers 93, 95 also define the paths of the collator belts and are operable to adjust the tension in each belt loop. The tension of diverter belts 78, 80 can also be adjusted with belt take-up rollers A and B, which are connected via a pivotable lever arm to an air actuator (not shown) that applies adjustable pressure. Since the tension in all four belts 78, 80, 92 and 94 can be adjusted, adjustable pressure between opposed belts results to positively hold and transport signatures at tape speeds.

Rollers 62 and 96 include two similar gears (not shown) which mesh with each other so that belt 92 is driven at the same speed as belt 78. Similarly, rollers 64 and 98 include gears (not shown) which mesh with each other so that belt 94 is driven at the same speed as belt 80.

The secondary signature controller 72 includes a soft nip 122 defined by idler roller 66 operating with the abaxially disposed idler roller 108, the diverter belt 78, and the collator belt 92. Similarly, the secondary signature controller 74 includes a soft nip 124 defined by idler roller 68 operating with the abaxially disposed idler roller 112, the diverter belt 80, and the collator belt 94.

Figure 2:
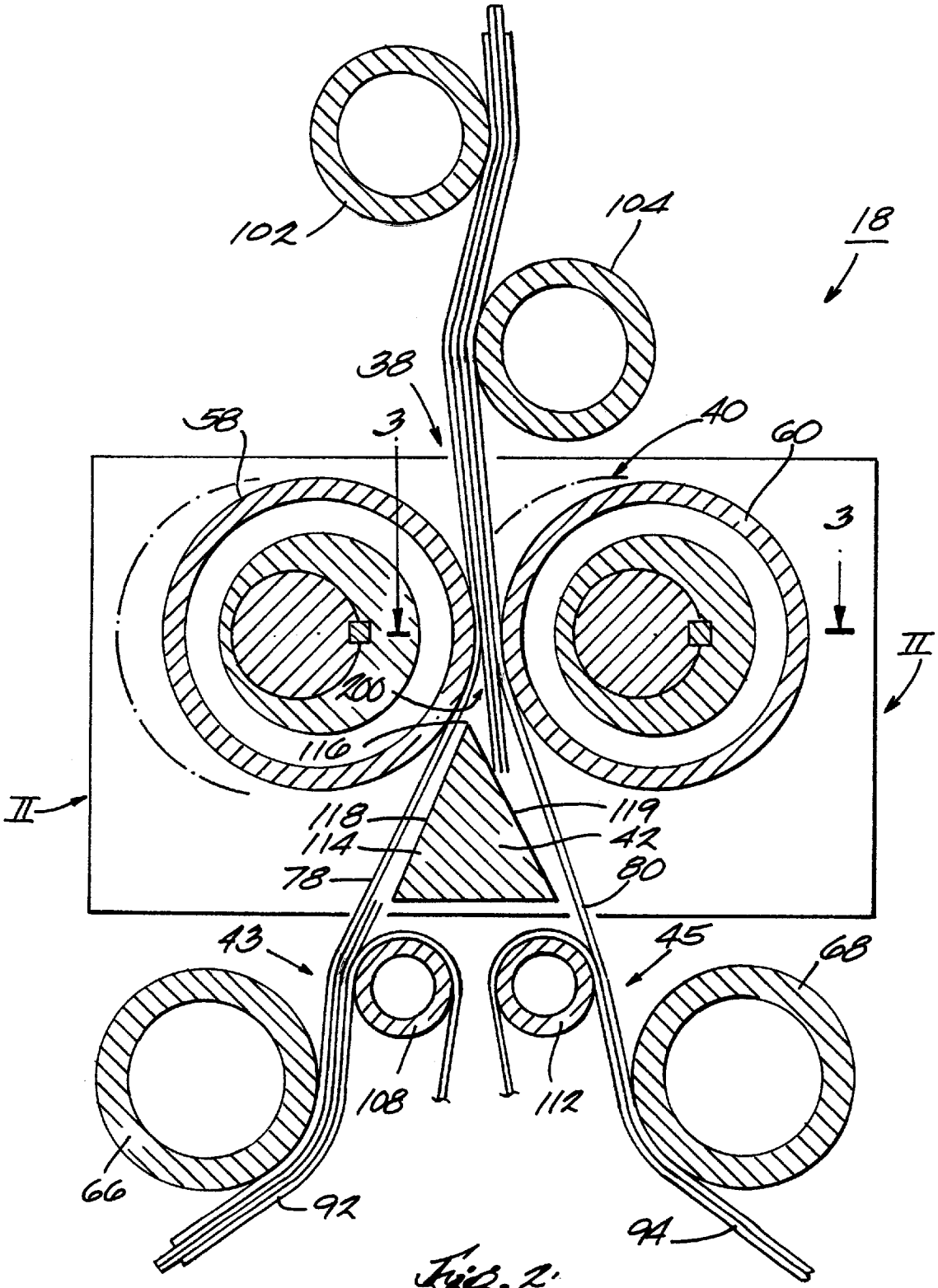
FIG. 2 is a sectional view through the diverting section of a sheet diverter of FIG. 1 showing in phantom lines the manner in which a guide mechanism reciprocates to direct signatures to alternative collation paths.

With reference to FIGS. 1 and 2, the diverter 38 is comprised of oscillating diverter guide means 40 and diverter means 42. The oscillating diverter guide means 40 includes a pair of counter-rotating diverter rolls 58 and 60 which are associated to create linear reciprocation of a diverter nip 200. The rolls translate over a reciprocable path during oscillation as can be observed in FIG. 2. The diverter means 42 includes a diverter wedge 114 having an apex 116 and diversion surfaces 118 and 119.

In operation, first and second diverter belts 78 and 80 carry individual signatures toward the diverter 38. The diverter rolls 58 and 60 are rotatable about their respective shafts and translate so that the nip 200 is moved from one side to the other side of the diverter wedge 114. The first signature is guided along one diversion surface 118 of the wedge 114. As the signature moves through the nip 200, the diverter rolls 58 and 60 translate so that nip 200 moves to the other side of the wedge 114. In this manner, the successive signature is diverted to the other side of the wedge 114 along the diversion surface 119.

At high printing press speeds (e.g., 2,500 fpm or more), the trailing end of the first signature may be damaged due to whipping of the printed signature at the apex 116 of the wedge 114 because the nip 200 may move to the other side of the diverter wedge 114 before the whole signature has passed the apex 116 of the wedge 114. Previously, this undesired whipping may occur because the two diverter rolls 58 and 60 and the gap 200 therebetween move toward the other side of the diverter wedge 114 in order to feed the next signature to the proper collation path 43 or 45. The whipping occurs because the nip 200 defined between the diverter rolls 58 and 60 may translate past the apex 116 of the wedge 114 before the signature currently being fed has completely passed the apex 116 as it moves down its collation path 43 or 45.

A solution to the problem of damaging signatures as outlined above is to provide an advance/retard mechanism for the drive means of the diverter rolls according to the present invention. This mechanism delays movement of the nip from one side of a wedge to the other side of the wedge until the trailing end of a signature has passed or has mostly passed the apex of the wedge. The mechanism then advances the nip to the other side of the wedge so that the leading edge of the successive signature can be diverted to the other side of the wedge before the leading edge reaches the vertex of the diverter wedge. The details and operation of advance/retard mechanisms according to the principles of the present invention are now described hereafter.

Figure 3:
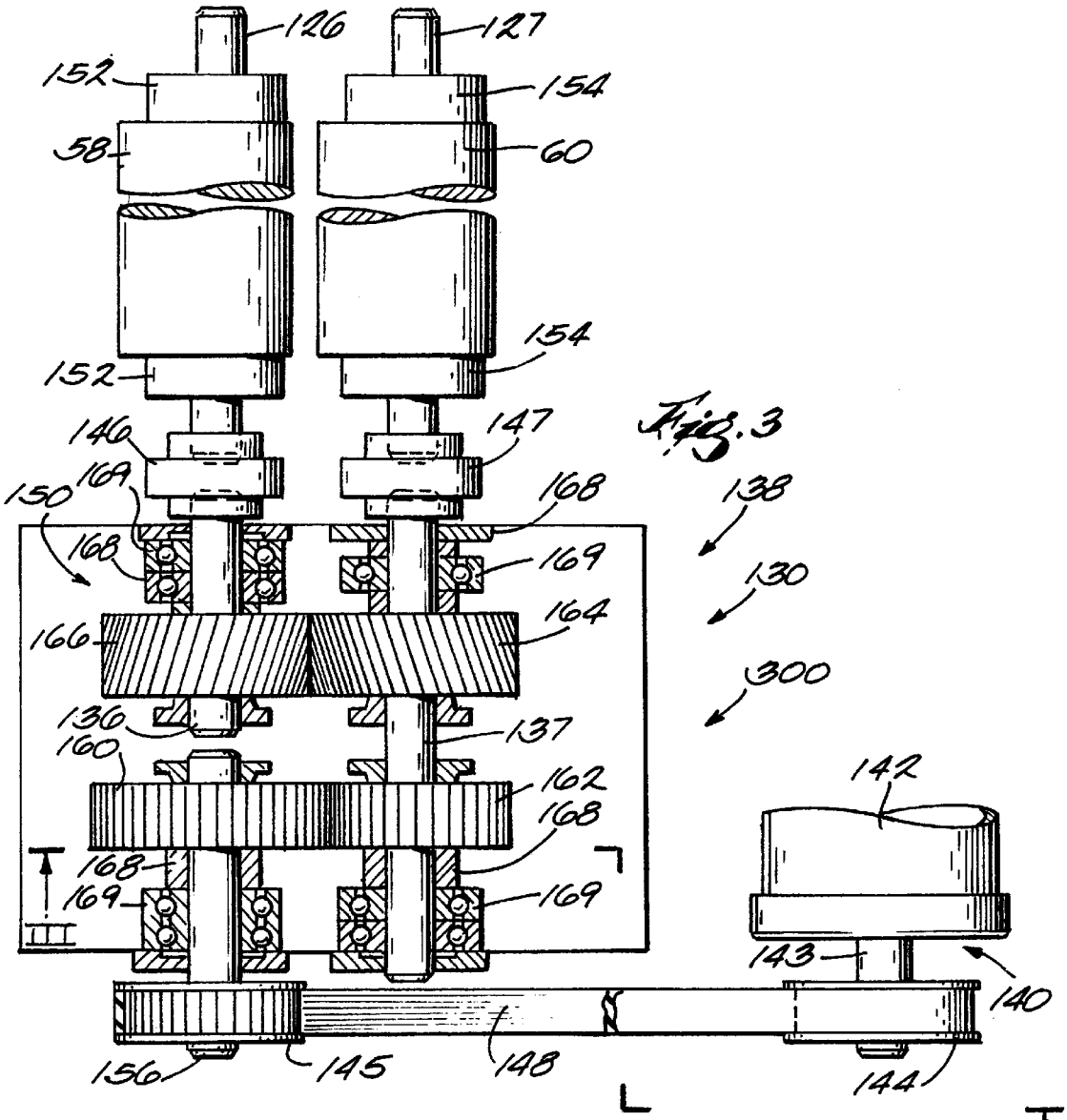
FIG. 3 is a top view of the diverter rolls of FIG. 2 showing a gear box, with the top portion removed, containing one embodiment of an advance/retard mechanism according to the present invention.

Shown in FIG. 3 is one embodiment of a diverter assembly of the present invention. Shown is an advance/retard mechanism or non-uniform drive 300 according to the present invention. Shown is a top view of the diverter rolls 58 and 60 coupled to a drive mechanism 130. Preferably, diverter rolls 58 and 60 are generally mounted on 0.25 inch eccentric centers. Each of the eccentrically rotatable diverter rolls 58 and 60 is designed to be preferably approximately one-quarter inch off axis, to yield a full eccentric throw of about one-half inch. Counterweights 152 and 154 are secured at opposite ends of shafts 126 and 127 of eccentric rolls 58 and 60, respectively. The counterweights 152 and 154 function to assist in dynamically balancing the eccentric rolls during rotational operation. Shafts 126 and 127 are coupled to shafts 136 and 137, respectively, by way of shaft coupling devices 146 and 147. Shafts 136 and 137 are part of the overall advance/retard mechanism 150 shown within gearbox 138. In FIG. 3, the top part of gearbox 138 has been removed in order to clearly show the advance/retard mechanism 150.

Previous designs, which do not have an advance/retard mechanism according to the present invention, would drive shafts which are similar to shafts 126 and 127 in opposite directions but at a steady angular rate referred to as "uniform angular velocity" which could lead to the problems heretofore mentioned. According to one aspect of the present invention, there is provided an apparatus and method to drive shafts 126 and 127 at a non-steady angular velocity which is intended to solve the previously mentioned problems. In other words, shafts 126 and 127 accelerate and decelerate for every shaft revolution as will be further explained below. This in turn modifies the movement or translation of the reciprocating nip or gap 200 according to the principles of the present invention, which will also be further discussed below.

Figure 3A:
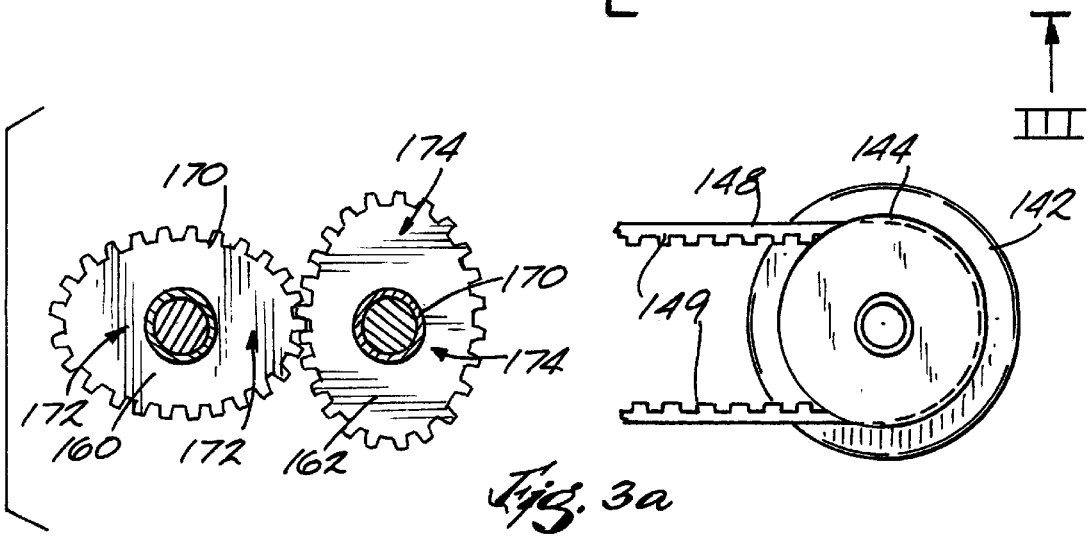
FIG. 3*a* is a side view taken along lines III—III of FIG. 3 showing elliptical gears according to the present invention.

Located on one side of gearbox 138 is a belt drive device 140. Belt drive device 140 includes a power device 142, a shaft 143, a timing pulley 144, a timing pulley 145, and a timing belt 148. Power device 142 provides the means necessary to rotate shaft 143. Pulley 144 is secured to shaft 143. Belt 148 includes teeth 149 as shown in FIG. 3*a*. As power device 142 rotates shaft 143, belt 148 drives pulley 145 in a manner generally known to those in the art. The belt drive 140 usually operates at a constant RPM or speed, whatever is necessary for a given application.

Pulley 145 is fixedly attached to shaft 156. In this way, as pulley 145 rotates as a result of movement of belt 148, shaft 156 rotates. Gear 160 is secured to shaft 156 and is rotationally driven as shaft 156 rotates. Gear 160 meshes with gear 162. As gear 160 rotates, gear 160 drives gear 162. Shaft 137 is fixedly attached to gears 162 and 164. As gear 162 rotates, shaft 137 rotates.

Angular rotation of shaft 137 translates to angular rotation of the shafts 126 and 127 upon which are mounted idler rolls 58 and 60 with bearings (not shown), respectively. Rolls 58 and 60 preferably freely spin on their respective shafts 126 and 127 by virtue of the bearing mountings. Belts 78 and 80 cause the idler rolls 58 and 60 to spin on their bearings. Shafts 126 and 127 actually move the location of the idler rolls 58 and 60 with respect to the diverter wedge 114 (FIG. 2) and thus assist in the translation of the nip 200. Gear 164 meshes with gear 166. As gear 164 rotates, gear 164 drives gear 166. Shaft 136 is secured to gear 166 and as gear 166 rotates, shaft 136 rotates. Shafts 136 and 137 turn in opposite directions since gears 166 and 164 are meshing gears. Shafts 126 and 127 of diverter rolls 58 and 60 are coupled to shafts 136 and 137, respectively, by way of shaft coupling devices 146 and 147, respectively. Thus, as shafts 136 and 137 rotate, shafts 126 and 127 rotate in opposite directions thereby moving diverter rolls 58 and 60 and nip 200 respectively. Housings 168 partially surrounding shafts 156, 137 and 136 are shown in cross section to show ball bearings 169. The rotational operation of shafts 156, 137 and 136 are generally understood by those skilled in the art. Thus, further description of the cooperation of the ball bearings 169 and shafts to effectuate rotation, is not provided.

FIG. 3*a* shows the counter-rotating gears 160 and 162 according to the present invention. Each gear 160 and 162 is secured to shafts 156 and 137, respectively, in a manner generally known to those skilled in the art. A taper lock bushing or split taper bushing 170, generally known to those skilled in the art, may be utilized to assist in properly positioning gear 160 with respect to gear 162 depending on the desired rotational cooperation. Such bushings are generally known to those skilled in the art and are available from a number of commercial suppliers such as, for example, Browning. Gears 160 and 162 are shown as elliptical gears. Elliptical gears 160 and 162 make up one embodiment of the drive mechanism according to the present invention.

The set of elliptical gears 160 and 162 each have two lobes 172 and 174, respectively. The gears are identical in size and tooth form (spur gears). This type of elliptical gear is often known as a "bi-lobe" type.

As previously described, the timing belt 148; the shafts 143, 156, 137, 136, 126 and 127; the timing pulleys 144 and 145; the gears 160, 162, 164 and 166; and the diverter rolls 58 and 60 are all universally coupled together. That is, as shaft 143 rotates as a result of the power device 142, the remaining just mentioned parts will be caused to rotate, or translate in the case of idler rolls 58 and 60. The elliptical gears 160 and 162 provide a specific non-uniform angular velocity drive thereby effecting the location of the reciprocating diverter rolls 58 and 60.

Shaft 156 and gear 160 can also be referred to as the input shaft and the input gear, respectively. Input shaft 156 rotates at a constant uniform angular velocity as a result of it being coupled to shaft 143 via belt 148 and timing pulleys 144 and 145 and power device 142 which operates at a constant angular velocity. Shaft 137 and gear 162 are also sometimes referred to as the output shaft and the output gear, respectively. Shaft 137 rotates at a variable non-uniform angular velocity as a result of its connection to elliptical gear 162 which meshes with elliptical gear 160.

The elliptical gears 160 and 162 by virtue of their universal connection to shafts 137 and 136, will change the rotated angular position of shafts 137 and 136 with respect to input shaft 156. This will allow for the ability to alter the position of shafts 137 and 136 with the same input shaft's 156 position. The shaft 137 or gear 162 can either lag or advance a predicted amount of degrees depending on the position of the output gear 162 to a selected position of the input shaft 156 or gear 160. In other words, elliptical gears 160 and 162 effect the movement of shafts 126 and 127 as compared to the movement that would be caused by standard, non-elliptical gears. It is known in the art that standard gears yield uniform angular velocity on the output shaft. The elliptical gears according to the present invention advantageously yield non-uniform angular velocity on the output shaft.

The elliptical gears are preferably standard elliptical spur type gears known to those skilled in the art and made of material appropriate for the particular application, as generally understood by those skilled in the art. However, for purposes of explanation and example, the following discussion is provided.

With reference to FIGS. 3*b*–3*f*, it can be observed that the radius to the pitch line around the gears 160 and 162 is not uniform as is standard with normal round gears. This changing radius provides a gear ratio that changes as the gears rotate from 0 degrees to 180 degrees and from 180° to 360°. As will be further explained, the changing gear ratio or changing pitch radius causes the output shaft to turn at a non-uniform varying angular velocity even though the input shaft turns at a constant angular velocity.

The definition of the pitch diameter for standard round spur gears is measured from its center of rotation to the gear's pitch line multiplied by two. The pitch diameter for elliptical gears takes the shape of an ellipse. The radius of its pitch diameter changes as it is swept around the gear.

The K factor of elliptical gears as understood by those skilled in the art, is the ratio of an elliptical gear's pitch diameter (or radius) between the long axis versus the short axis of the gear. For example, if the large radius "a" of the gear equals 1.750 inches and the small radius "b" of the gear equals 1.400 inches, K equals "a" divided by "b" or 1.750 divided by 1.400 equaling 1.25, or, stated differently, "a" equals 1.25 times "b".

Another function of the elliptical gears pertaining to the present invention is how the output gear 162 changes its rotational displacement at greater and smaller amounts then that of the mating input gear 160. This phenomenon is directly related to the changing of the angular output speed of the output gear 162 or output shaft 137 as compared to the constant angular input speed of input gear 160 or input shaft 156.

FIGS. 3*b*–3*f* demonstrate the angular rotational position of output gear 162 with respect to the angular rotational position of input gear 160. As explained, input gear 160 rotates at a constant angular velocity due to shaft 156 being driven at a constant angular velocity. Table I is provided to help demonstrate the relative rotational positions of gears 160 and 162 as the input shaft of gear 160 turns from 0 degrees to 180 degrees.

TABLE I

Elliptical Gears - "2 Lobe Type"
Output Angular Position vs. Input Angular Position
(with a K-Factor of 1.25)

| Angle Input | Angle Output | Delta Degree |
|---|---|---|
| 0 | 0 | 0 |
| 2 | 2.50 | 0.50 |
| 4 | 5.00 | 1.00 |
| 6 | 7.48 | 1.48 |
| 8 | 9.96 | 1.96 |
| 10 | 12.43 | 2.43 |
| 12 | 14.88 | 2.88 |
| 14 | 17.31 | 3.31 |
| 16 | 19.72 | 3.72 |
| 18 | 22.10 | 4.10 |
| 20 | 24.46 | 4.46 |
| 22 | 26.80 | 4.80 |
| 24 | 29.10 | 5.10 |
| 26 | 31.37 | 5.37 |
| 28 | 33.61 | 5.61 |
| 30 | 35.82 | 5.82 |
| 32 | 37.99 | 5.99 |
| 34 | 40.14 | 6.14 |
| 36 | 42.25 | 6.25 |
| 38 | 44.32 | 6.32 |
| 40 | 46.37 | 6.37 |
| 42 | 48.38 | 6.38 |
| 44 | 50.36 | 6.36 |
| 46 | 52.31 | 6.31 |
| 48 | 54.23 | 6.23 |
| 50 | 56.13 | 6.13 |
| 52 | 57.99 | 5.99 |
| 54 | 59.83 | 5.83 |
| 56 | 61.65 | 5.65 |
| 58 | 63.44 | 5.44 |
| 60 | 65.21 | 5.21 |
| 62 | 66.96 | 4.96 |
| 64 | 68.68 | 4.68 |
| 66 | 70.39 | 4.39 |
| 68 | 72.09 | 4.09 |
| 70 | 73.77 | 3.77 |
| 72 | 75.43 | 3.43 |
| 74 | 77.08 | 3.08 |
| 76 | 78.72 | 2.72 |
| 78 | 80.35 | 2.35 |
| 80 | 81.97 | 1.97 |
| 82 | 83.59 | 1.59 |
| 84 | 85.19 | 1.19 |
| 86 | 86.80 | 0.80 |
| 88 | 88.40 | 0.40 |
| 90 | 90.00 | 0.00 |
| 92 | 91.60 | −0.40 |
| 94 | 93.20 | −0.80 |
| 96 | 94.81 | −1.19 |
| 98 | 96.41 | −1.59 |
| 100 | 98.03 | −1.97 |
| 102 | 99.65 | −2.35 |
| 104 | 101.28 | −2.72 |
| 106 | 102.92 | −3.08 |
| 108 | 104.57 | −3.43 |
| 110 | 106.23 | −3.77 |
| 112 | 107.91 | −4.09 |
| 114 | 109.61 | −4.39 |
| 116 | 111.32 | −4.68 |
| 118 | 113.04 | −4.96 |
| 120 | 114.79 | −5.21 |
| 122 | 116.56 | −5.44 |
| 124 | 118.35 | −5.65 |

TABLE I-continued

| Elliptical Gears - "2 Lobe Type" Output Angular Position vs. Input Angular Position (with a K-Factor of 1.25) | | |
|---|---|---|
| Angle Input | Angle Output | Delta Degree |
| 126 | 120.17 | −5.83 |
| 128 | 122.01 | −5.99 |
| 130 | 123.87 | −6.13 |
| 132 | 125.77 | −6.23 |
| 134 | 127.69 | −6.31 |
| 136 | 129.64 | −6.36 |
| 138 | 131.62 | −6.38 |
| 140 | 133.63 | −6.37 |
| 142 | 135.68 | −6.32 |
| 144 | 137.75 | −6.25 |
| 146 | 139.86 | −6.14 |
| 148 | 142.01 | −5.99 |
| 150 | 144.18 | −5.82 |
| 152 | 146.39 | −5.61 |
| 154 | 148.63 | −5.37 |
| 156 | 150.90 | −5.10 |
| 158 | 153.20 | −4.80 |
| 160 | 155.54 | −4.46 |
| 162 | 157.90 | −4.10 |
| 164 | 160.28 | −3.72 |
| 166 | 162.69 | −3.31 |
| 168 | 165.12 | −2.88 |
| 170 | 167.57 | −2.43 |
| 172 | 170.04 | −1.96 |
| 174 | 172.52 | −1.48 |
| 176 | 175.00 | −1.00 |
| 178 | 177.50 | −0.50 |
| 180 | 180.00 | 0.00 |

The data for Table I was calculated using elliptical gears having a large radius of 1.750 inches and a small radius of 1.400 inches. Although gears of other sizes may be used according to the present invention, gears of the noted sizes are particularly suited for the operation of the present invention. Gears of the size described have a K-Factor of 1.25. The angular position of output gear 162 (Angle Output of Table I) is calculated according to the following equations when the angular position of input gear 160 (Angle Input of Table I) is known.

For input angles in the range of 0–90 degrees,

Angle Output=arctan[(K)tan(Angle Input)]abs

For input angles in the range of 90–180 degrees,

Angle Output=180−[arctan((K)tan(Angle Input))abs]

where abs=absolute value; and

K=Largest Radius of Gear/Smallest Radius of Gear.

Referring to Table I and FIGS. 3*b*–3*f*, certain angular rotational positions of gears 160 and 162 shown in 3*b*–3*f*, coincide with the shaded in portions of Table I for Angle Input equals 0, 42, 90, 138, and 180 respectively. It should be noted that the cycle (or table repeats itself as the input angle changes from 180° to 360°. By way of operation of elliptical gears in general, as the rotational position of input gear 160 changes, the rotational position of output gear 162 also changes. For example, as input shaft of gear 160 is rotated 2 degrees in the clockwise direction, output shaft of gear 162 is rotated 2.50 degrees in the counter-clockwise direction. Depending on the relationship of the angular positions of the two gears, either gear 162 will rotate faster than gear 160, i.e. advance, or will rotate slower than gear 160, i.e., retard. Thus, the variable rotational angular velocity of gear 162 will effectively advance or retard the translational movement of nip 200 with respect to the apex 116 of the diverter wedge 114 as a result of gear 162 being universally coupled to diverter shafts 137 and 136 as well as shafts 126 and 127. As shafts 137 and 136 rotate, which cause shafts 127 and 126 to rotate, counter-rotating diverter rolls 58 and 60, which are rotatable due to contact with remotely driven belts 78 and 80, oscillate transverse to the signature path. Because the diverter rolls 58 and 60 are eccentrically positioned around shafts 126 and 127, respectively, the nip 200 will transfer from one side 118 of diverter wedge 114 to the other side 119, as best shown in FIG. 2 and FIGS. 5–7.

The timing of the transfer of the nip 200 is important in maintaining the quality of the trailing end of a signature as it travels at high speeds past the apex 116 of a diverter wedge 114, as more fully explained herein. The effective angular rotation of shafts 126 and 127 of eccentrically rotating diverter rolls 58 and 60, and, thus, the translational movement of the nip 200, will be retarded or advanced (as compared to using standard round gears) depending on the angular relationship between input shaft 156 and input gear 160, and output shaft 137 and output gear 162.

Figure 3B:
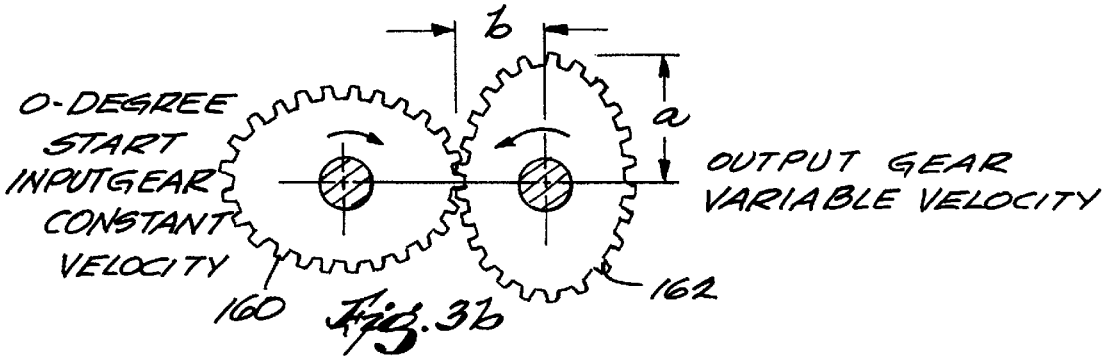
FIGS. 3*b*–3*f* are side views of the elliptical gears of FIG. 3 showing the gears in different rotational angular locations with respect to each other.
Figure 3C:
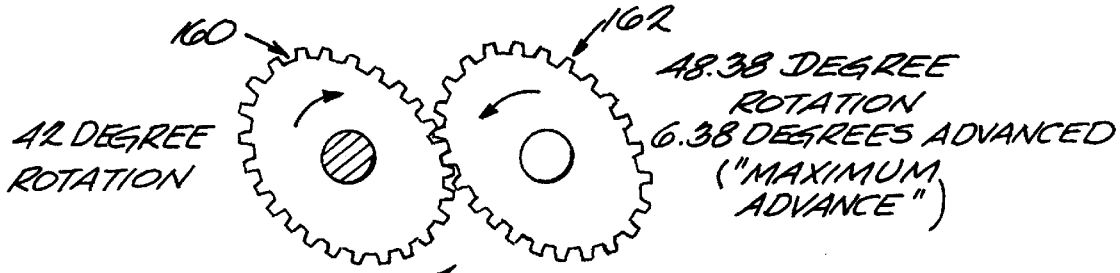
Figure 3D:
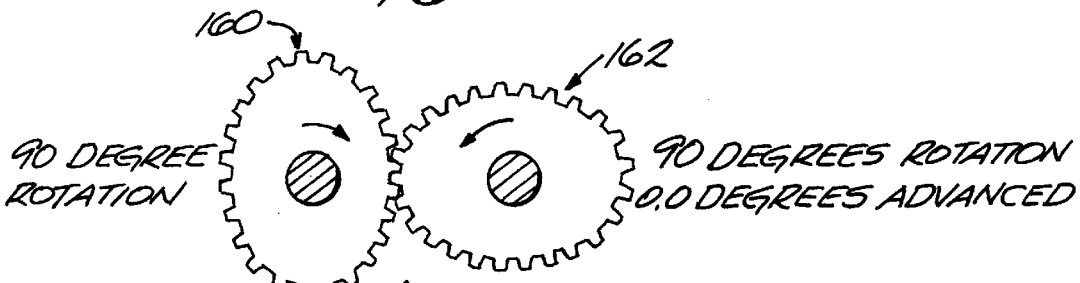
Figure 3E:
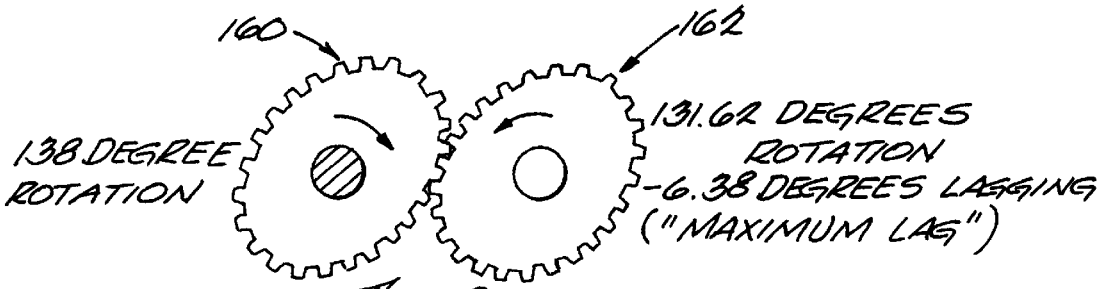
Figure 3F:
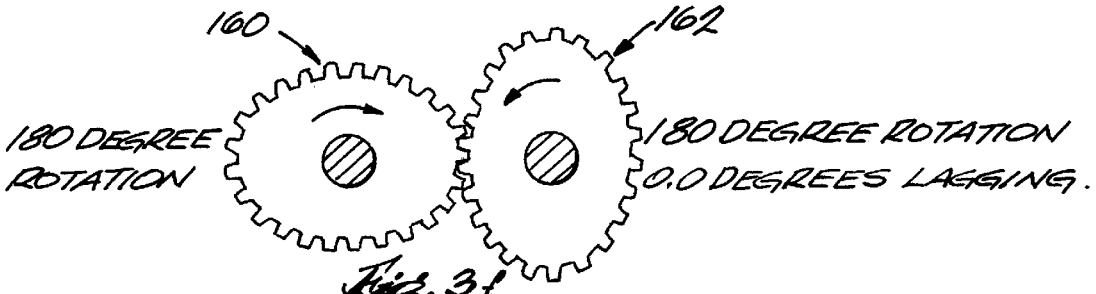

Shown in FIGS. 3*b*–3*f* with reference to Table I is the angular positional relationship of gears 160 and 162 at five different angular locations of the cycle. FIG. 3*b* has been designated the starting position for rotation of gears 160 and 162 for the sake of example. Moving from FIG. 3*b* to FIG. 3*c*, the input gear 160 or shaft rotates *42* degrees in the clockwise direction while the output gear 162 or shaft rotates in the counter-clockwise direction 48.38 degrees. With reference to Table I, gear 162 has relatively advanced 6.38 degrees more than gear 160. FIG. 3*d* shows the angular positional relationship of gears 160 and 162 where each gear has rotated 90 degrees. Gear 162 neither leads nor lags gear 160 at this position of the cycle. FIG. 3*e* shows that when input gear 160 has rotated 138 degrees, output gear 162 has rotated only 131.62 degrees. Thus, gear 162 lags gear 160 by 6.38 degrees. FIG. 3*f* illustrates the gears in their original starting rotational relationship and the cycle repeats itself during the next 180° of movement of the input gear 160.

For this particular gear example, it can be observed that from between 138 degrees and 42 degrees of the input gear 160, the output gear's 162 angular displacement gains on the input gear's 160 angular displacement by a Delta Degree amount. Between 42 degrees and 138 degrees of the input gear 160, the output gear's 162 angular displacement diminishes with respect to the input gear's 160 displacement by a Delta Degree amount. Thus, for a set of elliptical gears where K=1.25, the maximum values of Delta Degree occur at 42 degrees and 138 degrees . At 42 degrees, a maximum advance of 6.38 degrees occurs and at 138 degrees, a maximum lag of 6.38 degrees occurs. It should be understood that elliptical gear sets with different K values may be used and the examples provided herein are only intended for illustration purposes. The elliptical gears according to the present invention are not limited to gears with K values of 1.25.

The machine design of the elliptical gears 160 and 162, will set the maximum lag angle of the output gear 162 positioned with respect to the input gear 160. Setting the maximum lag to occur when the input gear 160 has rotated approximately 135 degrees may be well suited for the principals according to the present invention. Since this might not always be the best operating position for the gears, a set of taper lock bushings or split taper bushings 170 or similar devices in each of the elliptical gears is provided.

Taper lock bushings are generally known by those skilled in the art and, as a result, further description is not provided. Depending on the size of the gears used and the application in which the gears will be used, the taper lock bushings 170 will allow the user to calibrate where the best maximum lag should occur. It may also be desirable to change the timing of the arrival of the signatures with respect to the positioning of the diverter rolls. A phase adjuster or differential device may be coupled to the power input unit to advance or retard the positioning of the diverter rolls. The phase adjustment can be made while the machine is running. Differential devices and their manner of operation are commonly known to those skilled in the art and readily available from numerous sources. However, a Candy Differential available from Candy Mfg. Co., Inc. of Niles, Ill. is suitable for use in folders in which the present invention can be employed.

It should be noted that the selection process for choosing K factors for elliptical gears is generally based on two machine design criteria. The first criteria is size and mass of the rotating machinery. The second criteria is the rotating speed of all the rotating parts that will be driven directly or indirectly by the elliptical gears. This is an influencing factor because as the rotating speed is increased in the system, the torque to drive the system is increased by a square multiplying factor.

FIGS. 4 and 4*a* illustrate another embodiment of a diverter assembly of the present invention. Shown is a non-uniform drive 300. The elliptical gears 160 and 162 have been replaced by a conjugate cam system 210. The cam system 210 is positioned within conjugate cam box 216, the top of box 216 having been removed in FIG. 4 to clearly show the cam system 210. Although conjugate cam systems are generally understood by those skilled in the art and readily available from numerous commercial sources, such as, CAMCO Emerson Motion Controls, the following brief description is provided for a general understanding.

The belt drive device 140 is the same device as that described with the first embodiment of FIG. 3. Pulley 145 is secured to shaft 212. Shaft 212 is fixedly coupled to cam assembly 214. Cam assembly 214 includes a master cam 240, a conjugate cam 228, cam followers 218, 220, linear reciprocating beam 222, arms 230, 232, fastener assemblies 224, 226, 236, 234, and linear sliding bearings 242, 244.

The cam system 210 operates as follows. As input shaft 212 rotates, master cam 240 and conjugate cam 228 rotate since both are fixedly secured to shaft 212. The relative position of linear reciprocating beam 222 depends on the rotation of master cam 240 and conjugate cam 228. Cam followers 218, 220 are attached to linear reciprocating beam 222 by means of fastener assemblies 224, 226 (e.g., standard nut and bolt combination) and rotate on their axis with bearings to reduce friction on the cams 240 and 228. As shown in FIG. 4*a*, when cam follower 218 is located on the high end of cam 240, the cam follower 220 is located on the low end of cam 228. In other words, the cams 240 and 228 complement each other to prevent any backlash or end-play in the mechanism. The linear reciprocating beam 222 moves in a linear fashion by sliding in-between linear sliding bearings 242 and 244. Beam 222 will move back and forth in a linear fashion depending on the relationship of the cam followers 218, 220 with respect to cams 240 and 228, respectively. Arm 230 is rotatably attached to linear reciprocating beam 222, via fastener assembly 236 (e.g., standard nut and bolt combination). A second arm 232 is rotatably attached to arm 230 via fastener assembly 234. Ann 232 is fixedly secured to shaft 237. Gears 164 and 166 and the diverter roll shafts 126 and 127 are directly or indirectly coupled to shaft 237 and rotate in the manner previously set forth with respect to FIGS. 3 and 3*a*. As linear reciprocating beam 222 moves back and forth, the beam causes arms 230 and 232 to move in a locomotive type fashion. Since arm 232 is secured to shaft 237, and arm 232 rotates as a result of being indirectly coupled to input shaft 212, arm 232 causes output shaft 237 to rotate. During operation, arm 232 rotates completely around the center axis for shaft 237.

The input shaft 212 generally operates at a constant angular velocity. Output shaft 237 has a variable angular velocity due to the conjugate cam system 210 operation as outlined above and as generally understood by those skilled in the art. Other types of cam systems are also possible besides the "conjugate" cam system as explained here. The shape (contour) of cams 240 and 228 determine the exact nature of the variable angular velocity of the output shaft. By changing the cam contour, the type of output motion can be changed. The cam system 210 operates as an advance/retard mechanism similar to the elliptical gears previously described. The advance/lag operation is similar to that described for the elliptical gears.

The conjugate cam system 210 is just one type of power transmission system according to the principles of the present invention. Other devices or systems are capable of providing a constant angular velocity to an input shaft which converts into a desired variable angular velocity for an output shaft. As noted, for example, the cams in the cam system 210 can be provided with different contours or profiles to yield the desired output motion. However, the same could be done with a general mechanical linkage system without the use of cams.

The manner and operation of an advance/retard mechanism according to the present invention will now be further explained with reference to FIGS. 5–7.

FIGS. 5–7 show part of diverting section 18 of FIG. 2. Specifically shown are diverter rolls 58, 60, shafts 126, 127, diverter wedge 114, apex 116, signature diversion sides 118, 119, diverter belts 78, 80, diverter nip 200, collation paths 43, 45, signature 250 and its leading 254 and trailing 256 edges, and part of a next signature 252 and its leading edge 254. Gap 260 shown in FIG. 5 is defined by the outer surfaces of diverter rolls 58, 60 along line C which travels through the centers of rolls 58 and 60 such that rolls 58 and 60 rotate about the same plane. As shown in FIG. 2, rolls 58 and 60 are eccentrically mounted on shafts 126 and 127 but are free to spin on their respective bearings due to the driving action of the belts 78 and 80. During rotation of shafts 126 and 127, the size of gap 260, in which belts 78, 80 and signatures travel through, remains approximately constant.

Diverter nip plane 262 is defined as a substantially ninety degree vertical line through the apex 116 of diverter wedge 114. Gap 260 will translate or fluctuate to the left or right of diverter nip plane 262 as the eccentric driven diverter rolls 58, 60 translationally move. Depending upon which collation path 43, 45 a signature is traveling down, gap 260, according to the present invention, will not cross or substantially cross the diverter nip plane 262 until the trailing edge of the signature advances past the apex 116 of wedge 114. After which, the gap 260 will move or substantially move to the other side of the diverter nip plane 262 before the leading edge of a succeeding traveling signature reaches the apex 116. The gap 260 will not again cross or substantially cross the diverter nip plane 262 until the trailing edge of the succeeding signature has traveled beyond the vertex 116 of wedge 114. This process continues throughout the collation process.

Gap 260 moves between two outermost points, the dimension between the two points depends on the amount of eccentric of shafts 126 and 127. The speed at which the gap 260 moves in a back and forth motion depends upon an advance/retard mechanism according to the present invention and its relationship with diverter rolls 58 and 60.

With reference to the example provided in Table I (although Table I shows data as pertaining to elliptical gears, the principles set forth below apply equally as well to the cam system 210 and to any equivalent advance/retard mechanisms to those described herein), it is readily apparent that the variable angular velocity of shaft 137 will increase or decrease as compared to the constant angular velocity of shaft 156. The gap 260 moves along line C as diverter rolls 58 and 60 translate (see, for example, phantom lines in FIG. 2). The advance/retard mechanism operates in such a manner that as gap 260 is approaching diverter nip plane 262, the translation of gap 260, which relates to translation of rolls 58, 60, slows down. In this manner, as signature 250 is traveling down collation path 45 (see FIGS. 5 and 6), gap 260 does not cross or substantially cross diverter nip plane 262 before the trailing edge 256 of signature 250 advances past apex 116 of wedge 114. Once the trailing edge passes apex 116, the advance/retard mechanism operates in such a manner so as to speed up the translational movement of gap 260 along line C such that gap 260 crosses or substantially crosses diverter nip plane 262 before the leading edge 254 of the succeeding signature 252 reaches the apex 116 of wedge 114 (see FIGS. 6 and 7).

Thus, according to the present invention, whipping of the trailing edge of a signature around apex 116 is practically eliminated, thereby improving signature quality and allowing for increased machine speeds.

The foregoing description of the present invention has been presented for purposes of illustration and description. Furthermore, the description is not intended to limit the invention to the form disclosed herein. Consequently, variations and modifications commensurate with the above teachings, in skill or knowledge of the relevant art, are within the scope of the present invention. For example, timing the translation of the gap could be performed by any number of suitable mechanical components in conjunction with the use of a computer and/or the appropriate software. The embodiments described herein are further intended to explain best modes known for practicing the invention and to enable others skilled in the art to utilize the invention as such, or other embodiments and with various modifications required by the particular applications or uses of the present invention. It is intended that the appendant claims are to be construed to include alternative embodiments to the extent permitted by the prior art.

What is claimed:

1. A diverter assembly for diverting a signature to a desired one of a plurality of collation paths, said diverter assembly comprising:

a pair of rotating diverter rolls, said diverter rolls define a gap and signature path therebetween, wherein when said diverter rolls rotate, said gap moves between two points;

a diverter for deflecting a signature to a selected one of the collation paths, said diverter including an apex and diversion surfaces diverging from said apex, said apex having a diverter nip plane vertically located there through;

a drive mechanism coupled to said diverter rolls such that as said diverter rolls rotate, said gap translates from one of said points towards said diverter nip plane, said gap traversing across the diverter nip plane after a trailing end of a signature has substantially advanced past said apex and before a leading edge of a succeeding signature reaches said apex, said gap continuing to translate toward said other of said points and, once reached, translation of said gap reverses; and wherein said drive mechanism includes a pair of counter-rotating meshing elliptical gears, one gear being an input gear and said other gear being an output gear.

2. A diverter assembly according to claim 1, wherein said diverter includes a diverter wedge.

3. A diverter assembly according to claim 1, wherein said diverter rolls are eccentrically mounted upon respective shafts.

4. A diverter assembly according to claim 1, wherein said gap has a dimension that remains substantially constant during rotation of said diverter rolls.

5. A diverter assembly according to claim 1, where said elliptical gears include respective adjustable split taper bushings.

6. A diverter assembly according to claim 1, further comprising:

an input shaft attached to said input gear, said input shaft rotating at a substantially constant angular velocity; and an output shaft attached to said output gear, said output shaft rotating at a variable angular velocity.

7. A diverter assembly according to claim 6, further comprising:

a second pair of counter-rotating meshing gears, one of said gears of said second pair of gears being attached to said output shaft, said other gear of said second pair of gears being attached to a third shaft, said output shaft being coupled to one of said pair of diverter rolls and said third shaft being coupled to said other of said pair of diverter rolls.

8. A diverter assembly according to claim 1, wherein said elliptical gears are of a bi-lobe configuration.

9. A diverter assembly according to claim 8, wherein said elliptical gears have a K-factor of 1.25.

10. A diverter assembly according to claim 1, wherein said input gear rotates at a constant angular velocity and said output gear rotates at a variable angular velocity such that depending on the angular positions of said gears, said output gear, at times, rotates slower than said input gear and at other times, rotates faster than said input gear.

11. A diverter assembly according to claim 10, wherein each of said elliptical gears has a large pitch radius and a small pitch radius, respectively, said gears being positioned such that at time zero, a common plane extends through said large radius of said input gear and said small radius of said output gear, said sheet diverter being arranged such that when said input gear has rotated 135 degrees in one direction, said output gear lags behind said input gear in the other direction at a maximum.

12. A diverter assembly for diverting a signature to a selected one of a plurality of collation paths, said diverter assembly comprising:

at least two rollers arranged such that a signature passes between said rollers; and a drive system coupled to said rollers to rotate said rollers at a variable angular velocity.

13. A diverter assembly according to claim 12, further comprising:

a diverter which cooperates with said rollers to deflect the signature to a selected one of the collation paths.

14. A drive assembly for use in a diverter assembly which diverts a signature to a selected one of a plurality of collation paths and which includes at least two rollers which rotate about respective axes, said drive assembly being coupled to the rollers such that the rollers rotate about their respective axes at a non-uniform angular velocity.

15. The drive assembly as set forth in claim 14 wherein said drive assembly includes elliptical gears.

16. The drive assembly as set forth in claim 14 wherein said drive assembly includes conjugate cams.

17. A drive system for use in a diverter assembly which diverts a signature to a selected one of a plurality of collation paths and which includes at least two rotating rollers, said drive system coupled to the rollers to rotate each of the rollers at a variable angular velocity about an axis of rotation.

18. A method for collating signatures delivered from a printing press, said method comprising the steps of:

delivering a signature to a pair of counter-rotating rolls having a gap therebetween;

guiding a leading edge of the signature with a diverter;

translating said gap towards a diverter nip plane vertically located through an uppermost point of said diverter while the signature travels along a side of said diverter; and timing translation of said gap across said diverter nip plane after a trailing end of the signature has advanced substantially past said uppermost point of said diverter.

19. A diverter assembly for diverting a signature to a desired one of a plurality of collation paths, said diverter assembly comprising:

a pair of rotating diverter rolls, said diverter rolls define a gap and signature path therebetween, wherein when said diverter rolls rotate, said gap moves between two points;

a diverter for deflecting a signature to a selected one of the collation paths, said diverter including an apex and diversion surfaces diverging from said apex, said apex having a diverter nip plane vertically located there through;

a drive mechanism coupled to said diverter rolls such that as said diverter rolls rotate, said gap translates from one of said points towards said diverter nip plane, said gap traversing across the diverter nip plane after a trailing end of a signature has substantially advanced past said apex and before a leading edge of a succeeding signature reaches said apex, said gap continuing to translate toward said other of said points and, once reached, translation of said gap reverses;

wherein said drive mechanism further comprises an input shaft, an output shaft, and a conjugate cam assembly further including:

a plurality of cams secured towards one end of said input shaft, said cams positioned along said shaft one after another;

a linear reciprocating beam, said linear reciprocating beam positioned to move back and forth due to motion of said plurality of cams as said cams rotate by virtue of being connected to said input shaft;

a first pivotable arm fastened to said linear reciprocating beam;

a second pivotable arm fastened to said first pivotable arm, said second pivotable arm also being secured to said output shaft;

said linear reciprocating beam and arms being arranged such that as said beam reciprocates, said arms are caused to move in a locomotive motion thereby causing said output shaft to rotate.

20. A diverter assembly according to claim 19, wherein said input shaft rotates at a constant angular velocity and said output shaft rotates at a variable angular velocity.

21. A diverter assembly according to claim 20, further comprising a pair of counter-rotating meshing gears, one of said gears of said pair of gears being attached to said output shaft, said other gear of said pair of gears being attached to a third shaft, said output shaft being coupled to one of said pair of diverter rolls and said third shaft being coupled to said other of said pair of diverter rolls.

* * * * *